United States Patent [19]

Rawlins

[11] Patent Number: 4,925,138

[45] Date of Patent: May 15, 1990

[54] COLLAPSIBLE HAMMOCK STAND

[76] Inventor: Mark W. Rawlins, #11 - 12240 Horseshoe Way, Richmond, British Columbia, Canada, V7A 4X9

[21] Appl. No.: 237,236

[22] Filed: Aug. 26, 1988

[30] Foreign Application Priority Data

Sep. 18, 1987 [CA] Canada ..... 547228

[51] Int. Cl.[5] ..... F16M 11/32

[52] U.S. Cl. ..... 248/165; 5/127; 5/129; 108/112; 248/166; 248/188.6

[58] Field of Search ..... 5/127, 128, 129, 130; 108/111, 112, 113; 248/150, 188.6, 439, 165, 166

[56] References Cited

U.S. PATENT DOCUMENTS

| | | | |
|---|---|---|---|
| 142,327 | 9/1873 | Craft | 5/129 |
| 240,522 | 4/1881 | Ketcham | 5/128 |
| 381,025 | 4/1888 | Parmelee | 5/128 |
| 504,618 | 9/1893 | Reynolds | 5/129 |
| 1,063,461 | 6/1913 | Meeks | 5/129 |
| 3,593,352 | 7/1971 | Britt | 5/129 X |
| 4,691,394 | 9/1987 | Woo | 5/127 X |
| 4,797,961 | 1/1989 | Pasquariello | 5/127 |

FOREIGN PATENT DOCUMENTS

| | | | |
|---|---|---|---|
| 2853993 | 7/1980 | Fed. Rep. of Germany | 5/127 |

*Primary Examiner*—David L. Talbott

*Attorney, Agent, or Firm*—Klarquist, Sparkman, Campbell, Leigh & Whinston

[57] ABSTRACT

A collapsible hammock stand comprises a main body frame having a pair of opposed frame sections, each such section having a longitudinally extending upper rail interconnected with a pair of parallel spaced lower rails, the sections being pivotally interconnected at inner ends of their lower rails to permit pivotal movement between open and closed positions. A pair of support arms, each of which is also pivotal between open and closed position is also provided. A pair of support legs removably connectable with outer ends of the frame sections provides upright support for the stand when the frame sections are in their open position and a pair of coupling means removably connectable with upper ends of the support arms is provided for holding a hammock between the support arms.

11 Claims, 2 Drawing Sheets

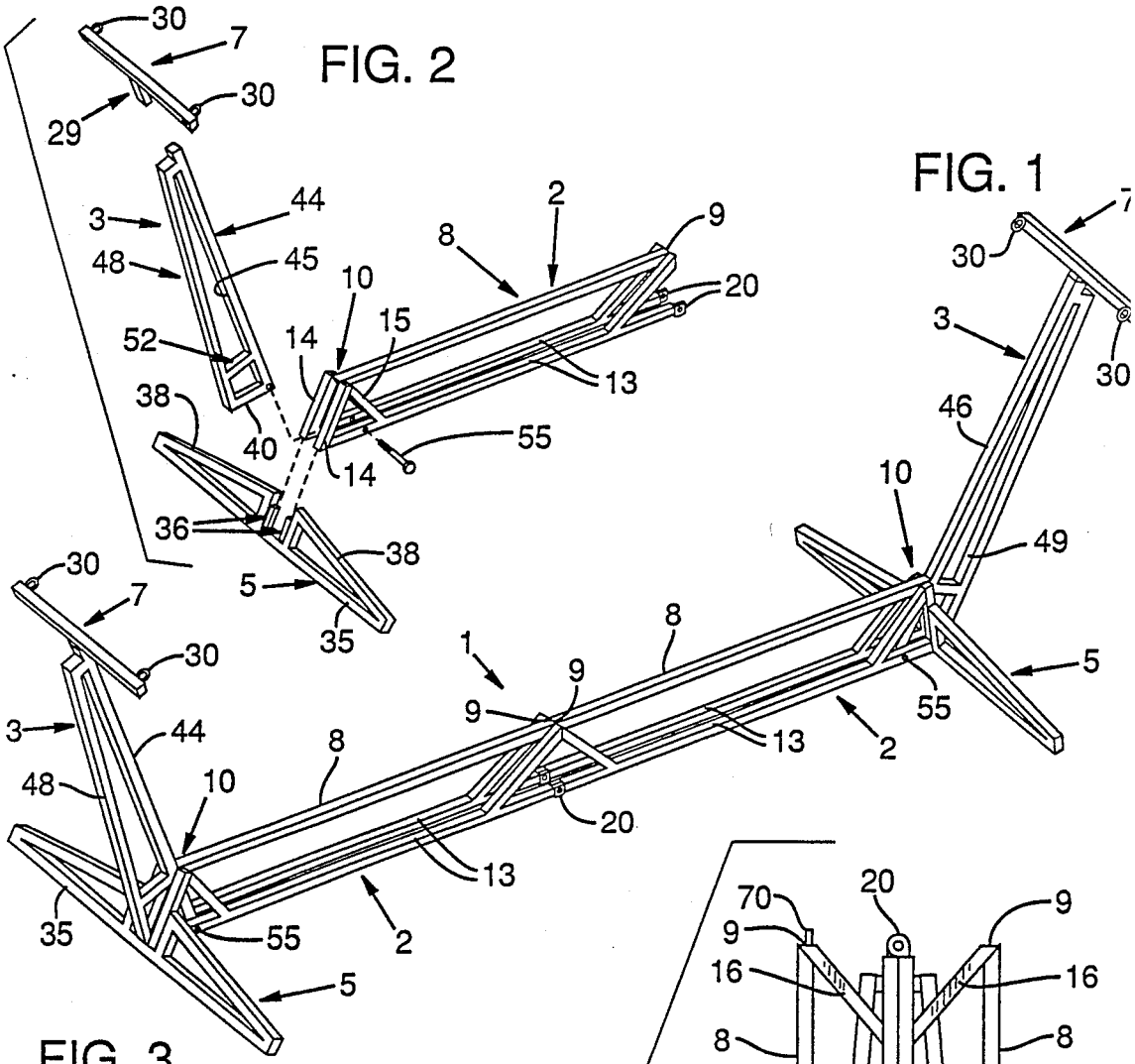
FIG. 2
FIG. 1
30
7
29
3
44
48
45
52
38
40
36
5
35
2
8
9
10
14
15
13
20
55
1
46
49
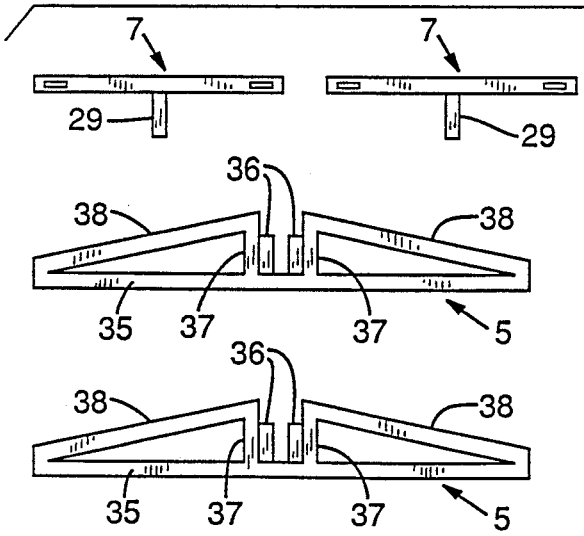
FIG. 3
7
29
36
38
35
37
5
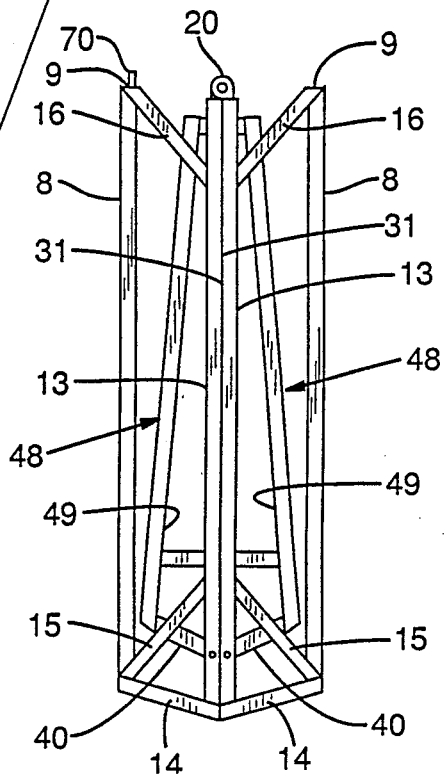
20
70
9
16
8
31
13
48
49
15
40
14

COLLAPSIBLE HAMMOCK STAND

BACKGROUND TO THE INVENTION

1. Field of the Invention

This invention relates to hammock stands and, more particularly, to free standing hammock stands that are collapsible.

2. Description of the Prior Art

The prior art is replete with designs for collapsible hammock stands. These designs vary in complexity, both in their manufacturing design and in their relative ease of assembly and disassembly by a user, and they also vary in weight, strength and durability. However, designs that are not complex, either from a manufacturer's or a user's point of view, and which may be made strong, lightweight and durable are elusive.

SUMMARY OF THE INVENTION

Accordingly, a primary object of the present invention is to provide a new and improved collapsible hammock stand that is easy to manufacture, requiring only a minimal raw material inventory of commonly available stock, and, when made, which a user may easily assemble and disassemble.

As well, it is an object of the present invention to provide a hammock stand which may be made from steel or other metal to provide strength and durability, yet in a conservative structure which is lightweight and portable.

In accordance with a broad aspect of the present invention, there is provided a collapsible hammock stand comprising a main body frame having a pair of opposed frame sections, each such section having a longitudinally extending upper rail interconnected with a pair of parallel spaced lower rails. The sections are pivotally interconnected at inner ends of their lower rails to permit relative pivotal movement of the sections between an open position where corresponding rails of the sections extend in line with one another and a collapsed position where undersides of corresponding lower rails of the sections abut one another. The stand includes a pair of support arms, each being pivotally connected between the lower rails of a different one of the frame sections. Each arm is pivotable between an open position where the arm extends upwardly from its lower end to an upper end disposed above and outwardly from the upper rail of the frame section to which it is connected and a closed position where the arm is received within the region between the upper and lower rails of the frame section to which it is connected. As well, the stand includes a pair of support legs removably connectable with outer ends of the frame sections for providing upright support for the stand when the frame sections are in their open position. In addition, a pair of coupling means removably connectable with upper ends of the support arms for holding a hammock between said support arms when the frame sections are in their open position.

Various features and advantages of the present invention will now be described with reference to the drawings.

BRIEF DESCRIPTION OF THE DRAWINGS

FIG. 1 is a perspective view of a collapsible hammock stand in accordance with the present invention.

FIG. 2 is an exploded perspective view of one-half of the hammock stand in FIG. 1.

FIG. 3 is an elevation view of components of the hammock stand in FIG. 1, shown in a collapsed and disassembled condition.

DETAILED DESCRIPTION OF THE INVENTION

Figure 4A:
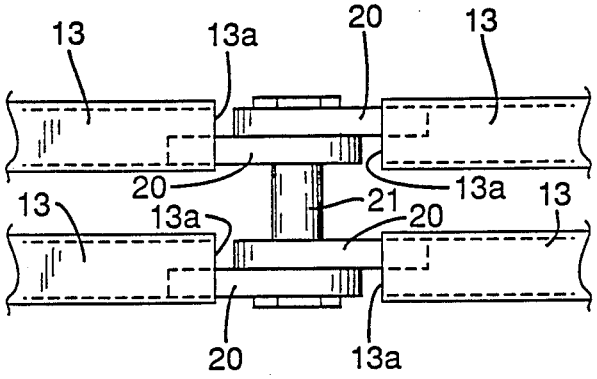
FIG. 4 consisting of FIGS. 4(*a*) and 4(*b*) is a top and side elevation view showing in more detail the pivotal interconnection between frame sections of the hammock stand in FIG. 1.

The hammock stand shown in FIG. 1 includes a main body frame generally designated 1, a pair of support arms 3, a pair of cross support legs 5, and a pair of T-bars 7, the latter of which serve as a coupling means for holding a hammock (not shown) between the support arms.

Frame 1 comprises a pair of opposed frame sections generally designated 2, each frame section including an upper rail 8 which serves as a main support rail and a pair of parallel spaced lower rails 13. As can best be seen in FIG. 2, upper and lower rails 8, 13 are interconnected in a truss-like manner by three pairs of load distribution members 14, 15, 16.

In a preferred embodiment, upper rail 8 and lower rails 13, as well as load distribution members 14, 15, 16 of each frame section are all made from standard stock, square, hollow metal tubing—preferably lightweight steel which is strong and durable, and which enables such parts to be easily welded together. Two tubular sizes are contemplated in the preferred embodiment; in a particular case, these sizes being $\frac{3}{4}$ inch square for upper rail 8 and load distribution members 14, and $\frac{5}{8}$ inch for lower rails 13 and load distribution members 15, 16.

Figure 4B:
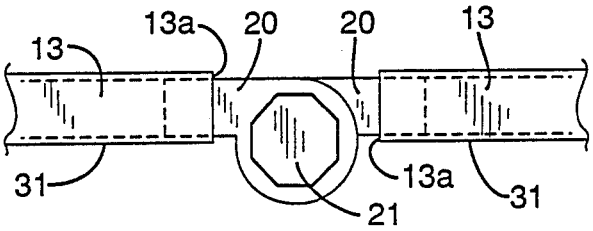

Frame sections 2 are pivotally interconnected at inner ends 132 of their lower rails 13, by means of a pivot pin 21 (shown only in FIG. 4) inserted through pin engaging brackets 20. Details of the interconnection are best shown in FIG. 4 which illustrates four brackets 20 partially inserted into the ends of lower rails 13 of the opposed frame sections and uniformly offset to the same inner side of each such rail (where they are welded in place during manufacture). The offset is such that corresponding lower rails of the sections extend smoothly in line with one another when the frame sections are in the open position shown in FIGS. 1 and 4. Such pivotal interconnection permits relative pivotal movement of frame sections 2 between the open position shown in FIGS. 1 and 4 and the collapsed position shown in FIG. 3. In the collapsed position, the undersides 31 of lower rails 13 abut one another.

The opening pivotal movement of frame sections 2 is limited when opposed inner ends 9 of upper rails 8 move into contact abutment with one another (viz. the position depicted in FIG. 1). In this position, upper rails 8 of the opposed frame sections, like lower rails 13, extend smoothly in line with one another.

As best seen in FIG. 2, support arms 3 each have an overall triangular configuration formed by a relatively short side member 40, a first relatively long side member 44, and a second relatively long side member 48. Within this triangular framework there is also a cross-member 52 which extends at right angles from inner side 45 of member 44 to inner side 49 of member 48.

ross-member 52 meets inner side 45 across from the 'ea where the outer side 46 of member 44 abuts upper il 8 (see below) and contributes to the load bearing ıpacity of the stand.

Each support arm 3 is pivotally connected at its wer end to one of the frame sections 2 by means of a vot pin 55. As will be appreciated from FIG. 1, the ɔnnection is made between lower rails 13 of the associ-ed frame section. The distance between rails 13 is just ıfficient to accomodate pivotal movement of the sup-ɔrt arm and, preferably, washers (not shown) carried / pin 55 on either side of the arm between the arm and e rails.

In FIG. 1, support arms 3 are shown in their open ɔsitions, and it can be seen that further opening pivotal ovement is limited by abutment contact between ıter side 46 of the arms and outer ends 10 of upper rails From this position (and in the absence of leg attach-ents 5) the arms may be pivoted back, under and up ;tween lower rails 13 of the frame section to which ey are respectively connected. At this point, as best .own in FIG. 3, each support arm 3 is received within e region between upper rail 8 and lower rails 13 of the e frame section to which it is connected. To achieve .ch containment, it will be noted that the length of side ember 44 is limited by the distance between pivot pin ; and pivot pin 21. Similarly, it will be noted that the aximum distance between side member 44 and side ember 48 is limited by the the distance between the ɔttom of upper rail 8 and the bottom of lower rails 13. ) restricted, a compact collapsed assembly as shown in [G. 3 becomes possible.

The framework of support arms 3 is conveniently ade from the same square tubular stock as described ɔve and used for upper rail 8. The upper open end of le member 44 then provides a convenient receptor for uare stem 29 of a T-bar 7. As noted above, T-bars 7 ovide a coupling means for holding a hammock be-/een support arms 2. In the case, illustrated, each ·bar includes a pair of extending loops 30 to enable ɔoking attachment of a conventional hammock (not own) which requires 4 corner lifting support.

Conveniently, the framework of T-bars 7 is made ɔm the same square tubular stock as described above .d used for lower rails 13. In addition, it may now be ɔserved that the larger size stock (viz. that used for le member 44) preferably has a tubular open size just fficient to slidingly receive the smaller size stock (viz. at used for T-bar 7).

Support legs 5 each comprise a base member 35 and pair of upwardly extending connector posts 36, each which posts is slidingly receivable by the bottom ɔening of one of the load distribution tubes 14. In FIG. posts 36 are fully received by tubes 14, the lower ends which tubes are flush with the bottom of bottom rails , all of which rests on top of base members 35 of the spective support legs. It will also be observed that the ɔttom end of side members 48 rest on top of base mem-rs 35. Thus it will be apparent that base members 35 ill block pivotal movement of support arms 3 from eir open positions when legs 5 are connected to frame ctions 2.

Conveniently, connector posts 36 are made from the ıaller size stock as described above so as to be slid-gly receivable by the larger size stock described ove.

Each support leg 5 further includes a pair upwardly tending side members 37, each of which side members is laterally braced against base member 35 by a bracing member 38. Each side member is displaced away from an adjacent connector post 36 by a distance just sufficient to accomodate the wall thickness of a load distribution tube 14 as the post is received by a the tube. When legs 5 are connected to frames sections 2, the sections frames are then effectively slidingly sandwiched between side members 37 thereby enhancing overall lateral bracing support of the stand. Base member 35, side members 37 and bracing members 38 are conveniently made from the larger size stock described above.

Figure 5:
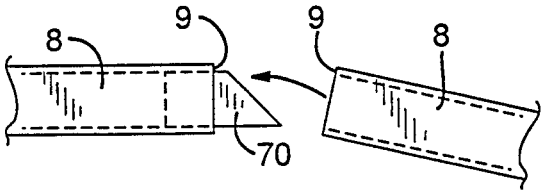
FIG. 5 is a side elevation view of showing a stabilizing plug between the upper rails of the frame sections.

To provide added stability in the open position, inner end 9 of one of upper rails 8 is preferably provided with a tapered plug 70 as illustrated in FIG. 5. Plug 70 may be conveniently cut from the smaller size stock described above, slidingly inserted into the open end of a rail 8 to the position shown in FIG. 5, then welded in place. When frame sections 2 are pivoted to their open position, such movement being indicated in FIG. 5, the extending tapered end of plug 70 will be slidingly received by the open inner end of the opposed rail 8.

Assembly of the hammock stand shown in the Figures from the collapsed and disassembled condition shown in FIG. 3 is a very simple matter. It is merely necessary to pivot frame sections 2 and support arms 3 to their open position, and then slidingly engage legs 5 and T-bars 7. Disassembly is simply the opposite.

Without reliance upon unduly heavy structural elements, and without departing from an overall simplicity and sleekness of design, a hammock stand made in accordance with the present invention will be found to have a load bearing capacity and stability sufficient to accomodate the vast majority of people. Indeed, using $\frac{5}{8}$ inch and $\frac{3}{4}$ inch stock as described above, weights of up to 300 pounds have been easily carried—and it appears probable that significantly heavier weights could be carried.

Various modifications and changes to the preferred embodiment of the invention that has been described and within the spirit and scope of the claims which follow will undoubtedly occur to those skilled in the art. For example, in the case of hammocks having singular connecting points at either end, the T-bar coupling mechanism might be replaced by a singular hooking arrangement disposed at the upper end of the side member 44 of each support 3. Other changes are possible.

I claim:

1. A collapsible hammock stand, comprising:

(a) a main body frame comprising a pair of opposed frame sections, each such section having a longitudinally extending upper rail interconnected with a pair of narrowly spaced parallel lower rails, each of said lower rails having an inner end and an underside, said sections being pivotally interconnected at opposed corresponding ones of said inner ends to permit relative pivotal movement of the sections between an open position where corresponding rails of the sections extend in line with one another and a collapsed position where said undersides of corresponding lower rails of the sections abut one another;

(b) a pair of support arms, each being pivotally connected at a lower end between the lower rails of a different one of said frame sections for pivotal movement between an open position where the arm extends upwardly from its lower end to an upper end disposed above and outwardly from the upper rail of the frame section to which it is connected and a closed position where the arm is closely received through said narrow spaced between said lower rails of the frame section to which it is connected to a position within the region between the upper and lower rails of the frame section to which it is connected;

(c) a pair of support legs removably connectable with outer ends of said frame sections for providing upright support of said stand when said frame sections are in their open position; and, (d) a pair of coupling means removably connectable with upper ends of said support arms for holding a hammock between said support arms when said frame sections are in their open position.

2. A hammock stand as defined in claim 1, wherein the opening pivotal movement of said frame sections is limited by abutment contact between opposed inner ends of said upper rails.

3. A hammock stand as defined in claim 2, the inner end of one of said upper rails having an opening for slidingly receiving a stabilizing plug extending from the inner end of the other of said upper rails.

4. A hammock stand as defined in claim 1, said support legs each including a base member and a pair of base connectors mounted to and extending upwardly from said base member for sliding connection with cooperating connectors mounted at outer ends of said frame sections.

5. A hammock stand as defined in claim 4, wherein said cooperating connectors comprise hollow tubes interconnecting said lower rails to said upper rails, each such tube having a bottom opening for slidingly receiving one of said base connectors.

6. A hammock stand as defined in claim 5, wherein said base members abut said support arms to block pivotal movement from their open positions when said legs are connected to said frame sections.

7. A hammock stand as defined in claim 1, each support arm having an overall triangular configuration formed by:

(a) a relatively short side member extending from an inner end coincident with the lower end of the support arm to an outer end;

(b) a first relatively long side member joined at one end at an acute angle with the inner end of said short side member and extending away therefrom to an opposed end coincident with the upper end of said support arm; and, (c) a second relatively long side member joined at one end with the outer end of said short side member and at an opposed end with the opposed end of said first side member.

8. A hammock stand as defined in claim 7, wherein the opening pivotal movement of said support arms is limited by abutment contact between outer sides of said first side members and outer ends of said upper rails.

9. A hammock stand as defined in claim 8, wherein each support arm includes a cross-member extending at a right angle from an inner side of said first side rail to an inner side of said second side rail.

10. A hammock stand as defined in claim 9, wherein said support legs, when connected to said frame sections with said support arms being in their open positions, abut said support arms to block pivotal movement from their open positions.

11. A hammock stand as defined in claim 7, wherein each coupling means comprises a T-bar having a stem slidingly connectable with the upper end of said support arms.

* * * * *